US007618823B2

(12) United States Patent
Barone et al.

(10) Patent No.: US 7,618,823 B2
(45) **Date of Patent: *Nov. 17, 2009**

(54) SYSTEM, METHOD AND APPARATUS FOR LOST FOAM CASTING ANALYSIS

(75) Inventors: Martin R. Barone, Skovde (SE); David A. Caulk, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 678 days.

This patent is subject to a terminal disclaimer.

(21) Appl. No.: 11/158,299

(22) Filed: Jun. 21, 2005

(65) Prior Publication Data

US 2006/0003456 A1 Jan. 5, 2006

Related U.S. Application Data

(60) Provisional application No. 60/584,008, filed on Jun. 30, 2004.

(51) Int. Cl.

| | |
|---|---|
| ***G01N 35/08*** | (2006.01) |
| *G06F 19/00* | (2006.01) |
| *B22D 46/00* | (2006.01) |
| *B22C 9/02* | (2006.01) |

(52) U.S. Cl. ..... 436/55; 164/457; 164/34; 164/4.1; 700/146

(58) Field of Classification Search ..... 700/146; 164/457, 4.1, 34

See application file for complete search history.

(56) References Cited

U.S. PATENT DOCUMENTS 7,164,963 B2 * 1/2007 Caulk ..... 700/146
7,225,049 B2 * 5/2007 Caulk ..... 700/146

OTHER PUBLICATIONS

Gurdogan, 0., et al., Mold-Filling Analysis for Ductile Iron Lost Foam Castings, AFS Transactions, vol. 104, pp. 451-459, 1996.
Hirt, C. W., and Barkhudarov, M. R., "Lost Foam Casting Simulation with Defect Detection," in Modeling of Welding, Casting and Advanced Solidification Processes VIII, Ed. by B. G. Thomas and C. Beckermann, TMS, Warrendale, 1998.
Houzeaux, G. and Codina, R., "A finite element model for the simulation of lost foam casting," Int. J. Numer. Meth. Fluids, vol. 46, pp. 203-226, 2004.

(Continued)

*Primary Examiner*—Jill Warden
*Assistant Examiner*—Bryan T Kilpatrick
(74) *Attorney, Agent, or Firm*—Reising Ethington P.C.

(57) ABSTRACT

Disclosed are a method, system and apparatus for analyzing foam decomposition in contact mode during mold filling in lost foam casting, the foam decomposition having a foam material vapor fraction and the mold filling having a mold filling speed. The method includes providing a plurality of parameter values for casting process parameters as variables of a plurality of predetermined equations, simultaneously solving the plurality of predetermined equations including the parameter values, calculating a vapor value for the fraction of the foam material that decomposes to vapor, an undercut length value designating the amount of coating exposed to gas diffusion, and a speed value for the mold filling speed, and determining whether to adjust at least one of the parameter values based on the results for the vapor value, the undercut length value, or the speed value.

20 Claims, 4 Drawing Sheets

OTHER PUBLICATIONS

Liu, Y., et al., "Numerical modeling and experimental verification of mold filling and evolved gas pressure in lost foam casting," J. of Materials Science, vol. 37, pp. 2997-3003, 2002.
Shivkumar, S., "Modelling of temperature losses in liquid metal during casting formation in expendable pattern casting process," Materials Science and Technology, vol. 10, pp. 986-992, 1994.
Tsai, H. L., and Chen, T. S., "Modeling of Evaporative Pattern Process, Part I: Metal Flow and Heat Transfer During the Filling Stage," AFS Transactions, vol. 96, pp. 881-890, 1988.
Wang, C. M., et al., "Computational Fluid Flow and Heat Transfer During the EPC Process," AFS Transactions, vol. 101, pp. 897-904, 1993.

* cited by examiner

SYSTEM, METHOD AND APPARATUS FOR LOST FOAM CASTING ANALYSIS

CROSS REFERENCE TO RELATED APPLICATION

This application claims priority to U.S. Provisional Application Ser. No. 60/584,008, titled, "LOST FOAM CASTING ANALYSIS METHOD," filed Jun. 30, 2004, which is incorporated by reference herein in its entirety.

TECHNICAL FIELD

Described are a system, method and apparatus that pertain to lost foam casting of metal alloys. More particularly, the system, method and apparatus pertain to evaluation, analysis, and manipulation of lost foam casting process parameters for production of products by a lost foam casting process.

BACKGROUND OF THE INVENTION

Lost foam casting (also called evaporative pattern casting and expendable pattern casting) evolved from the full mold process following the general availability of expanded polystyrene foam. In full mold casting, a bonded sand mold is formed around a foam pattern cut to the size and shape of the desired casting. Liquid metal is poured directly into the pattern, causing the foam to melt and then vaporize under the heat of the metal. Air and polymer vapor escape from the mold cavity through narrow vents molded into the sand above the pattern, allowing the liquid metal to displace the entire volume originally occupied by the foam. The full mold process is particularly useful for making large, one-off castings such as metal stamping dies.

The main difference between lost foam casting and the full mold process is that in lost foam casting the mold is made from loose sand, which is consolidated around the pattern by vibration. Vents are not required because the foam decomposition products are able to escape through the natural interstices between the sand grains. Patterns are molded to shape rather than cut from a larger foam block, and sometimes they are glued together from two or more pieces when internal passages do not allow them to be molded as one. After the pattern is assembled, it is dipped in a water-based refractory slurry and allowed to dry. This forms a porous coating on the surface of the pattern, which keeps the metal from penetrating the sand while still allowing the foam decomposition products to escape from the mold cavity. The coated pattern is then placed inside a steel flask and surrounded with loose, dry sand. Next, the flask is vibrated to consolidate the sand and encourage it to fill any open passages in the pattern. After that, liquid metal is poured into the pattern, which gradually gives way to the hot metal as its gas and liquid decomposition products diffuse through the coating and into the sand. Once the casting solidifies, the sand is poured out of the flask and the casting is quenched in water.

In the past few years, some lost foam foundries have begun using synthetic ceramic media in place of silica sand primarily because of its superior durability and its more insulative thermal properties. Here, the term sand is used in a generic sense to refer to any type of granular mold media.

As a process for making complex parts in high volume, lost foam casting has several important advantages. First, the molds for the foam patterns are relatively inexpensive and easy to make. Castings are free from parting lines, and draft angles can be reduced or even eliminated. Internal passages may be cast without cores, and many design features, such as pump housings and oil holes, can be cast directly into the part. Lost foam casting is more environmentally sound than traditional green sand casting because the sand can be cleaned and reused.

Unlike traditional casting processes (such as lost wax casting) where metal is poured directly into an empty mold cavity, the mold filling process in lost foam casting is controlled more by the mechanics of pattern decomposition than by the dynamics of metal flow. The metal advances through the pattern only as fast as foam decomposes ahead of it and the products of that decomposition are able to move out of the way. Before any liquid metal can flow into the cavity, it must decompose the foam pattern immediately ahead of it. As it does, some of the foam decomposition products can mix with the metal stream and create anomalies such as folds, blisters, and porosity in the final casting.

Lost foam casting has been used successfully with aluminum, iron, bronze, and more recently magnesium alloys. In the auto industry, for example, aluminum is used to make engine blocks and heads. Currently, more experimental data is available for aluminum than for any other material.

In spite of its many advantages, lost foam casting is still prone to fill-related process anomalies due to foam decomposition products that are unable to escape from the mold cavity before the casting solidifies. These anomalies are divided into four main categories. Gas porosity is created when foam decomposition products remain trapped inside the metal as it solidifies. Blisters form on the upper surfaces of castings when rising bubbles are trapped below a thin surface layer of solidified metal. Wrinkles form on casting surfaces when residual polymer liquid is caught between the metal and the coating and cannot escape before the casting solidifies. Sometimes, though, even when all the foam decomposition products do escape from the mold cavity, they still leave folds in the casting. A fold is a pair of unfused metal surfaces, usually contaminated by oxides and carbon residue, left behind when a pocket of polymer liquid or gas collapses on itself.

SUMMARY

Disclosed herein are a method, system, and apparatus for analyzing foam decomposition in contact mode during mold filling in lost foam casting. Contact mode is explained below. The method includes providing a number of values for casting process parameters as variables in a set of predetermined equations. The method also includes simultaneously solving the set of predetermined equations that include the parameter values. The method further includes calculating a vapor value for the fraction of the foam material that decomposes to vapor, an undercut length value designating the amount of coating exposed to gas diffusion, and a speed value for the mold filling speed, and determining whether to adjust at least one of the parameter values based on an analysis of the vapor value, the undercut length value and the speed value.

Contact mode is a distinct mode of foam decomposition. Contact mode occurs when the liquid metal makes direct contact with the solid foam, decomposing it by ablation. Contact mode involves a specific physical mechanism, and may occur under a particular set of process conditions. In fact, contact mode may be one of several different modes possible in the lost foam casting process.

In contact mode, both heat conduction and polymer vaporization take place in a narrow region, called the decomposition layer, that separates the liquid metal from the unmelted foam. The decomposition layer, typically about 150 microns thick, contains partially vaporized liquid foam. Since foam cells on the boundary of the pattern are able to exhaust their gas directly into the adjacent coating, bypassing the decomposition layer entirely, they collapse ahead of the metal front and create an undercut in the pattern next to the coating, which exposes an extended portion of the coating surface area to gas diffusion. The rate of formation of this undercut determines how fast the mold fills. In aluminum casting, the coating provides nearly all the resistance to gas diffusion; the contribution from the sand is negligible. Generally, the foam always decomposes in contact mode unless special circumstances arise that initiate a different mode.

DETAILED DESCRIPTION

Figure 1:
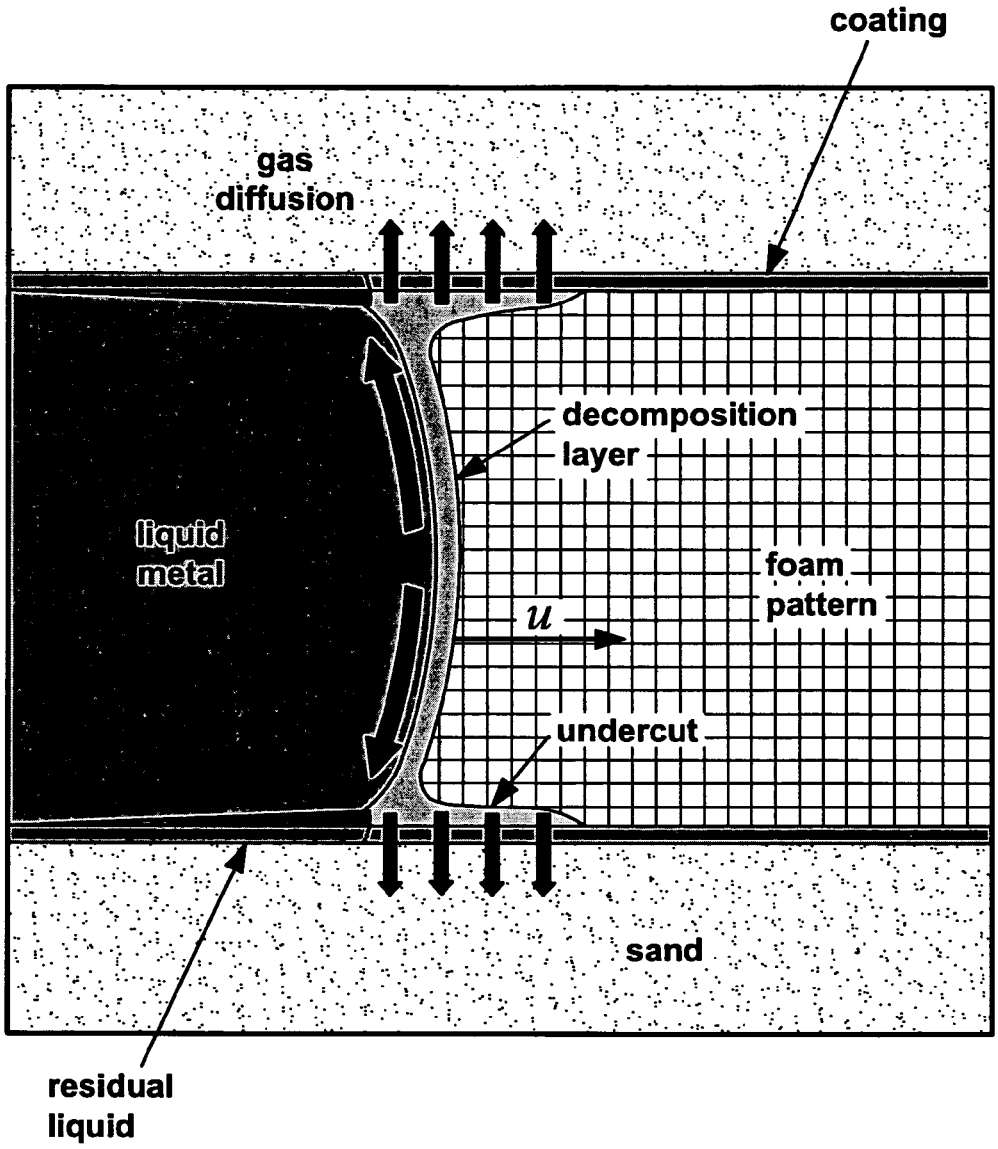
FIG. 1 shows a section through a mold cavity at a point on the flow front where foam decomposes in contact mode.

Disclosed herein are a system, method and apparatus for analyzing foam decomposition in contact mode during mold filling in lost foam casting. In general, when heated by liquid metal during the casting process, the foam decomposes into liquid and gas byproducts. Different conditions lead to different foam decomposition mechanisms, called modes. Herein is described contact mode. In contact mode, illustrated schematically by the section through the cavity thickness depicted in FIG. 1, the molten metal is separated from the solid pattern by a narrow band of liquid foam (about 150 microns thick), called the decomposition layer. The lower pressure in the sand draws the liquid foam through the decomposition layer until it reaches the coating, where the gas diffuses into the sand. Along the way, some of the polymer liquid vaporizes. Near the coating, the decomposition layer opens up into a much wider expanse, called the coating undercut, created by foam cells along the surface of the pattern that readily collapse because they can expel their contents directly into the adjacent coating.

The foam decomposition may be characterized by a foam material vapor fraction $x_v$, representing the mass fraction of foam material that vaporizes in the decomposition layer. The casting process may be further characterized by the length of a coating undercut $l_C$, that is, the amount of coating exposed to gas diffusion at the metal flow front. The casting process may also be characterized by a mold filling speed u, that is, the rate at which the surface of the liquid metal is advancing in the mold. Each of the vapor fraction, the length of the coating undercut, and the mold filling speed may have predetermined ranges as known to those skilled in the art.

As discussed further below, the method and system include providing values for casting process parameters as variables in a set of equations so that the below-described algorithm may provide boundary conditions on metal flow during a lost foam casting process, and may provide analysis and generate information used to improve the casting process. The casting process parameters may include properties of a casting metal, properties of the foam material, properties of a coating material for coating the foam, properties of a sand or ceramic material surrounding the coated foam, and properties characterizing the foam pattern geometry. The method and system also include solving a set of equations relating the thermal and other physical properties of the casting metal, the foam material, the coating and sand, and one or more characteristics of the pattern geometry. In solving the set of equations, the following values may be calculated: the foam material vapor fraction, the length of the undercut, and the mold filling speed. Output of one or all of the vapor fraction value $x_v$, the undercut length value $l_C$, and the filling speed value u may be used in an analysis to determine whether to adjust at least one of the casting process parameters.

This invention may be embodied in the form of any number of computer-implemented processes and apparatuses for practicing those processes. Embodiments of the invention may be in the form of computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention may also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

Figure 2:
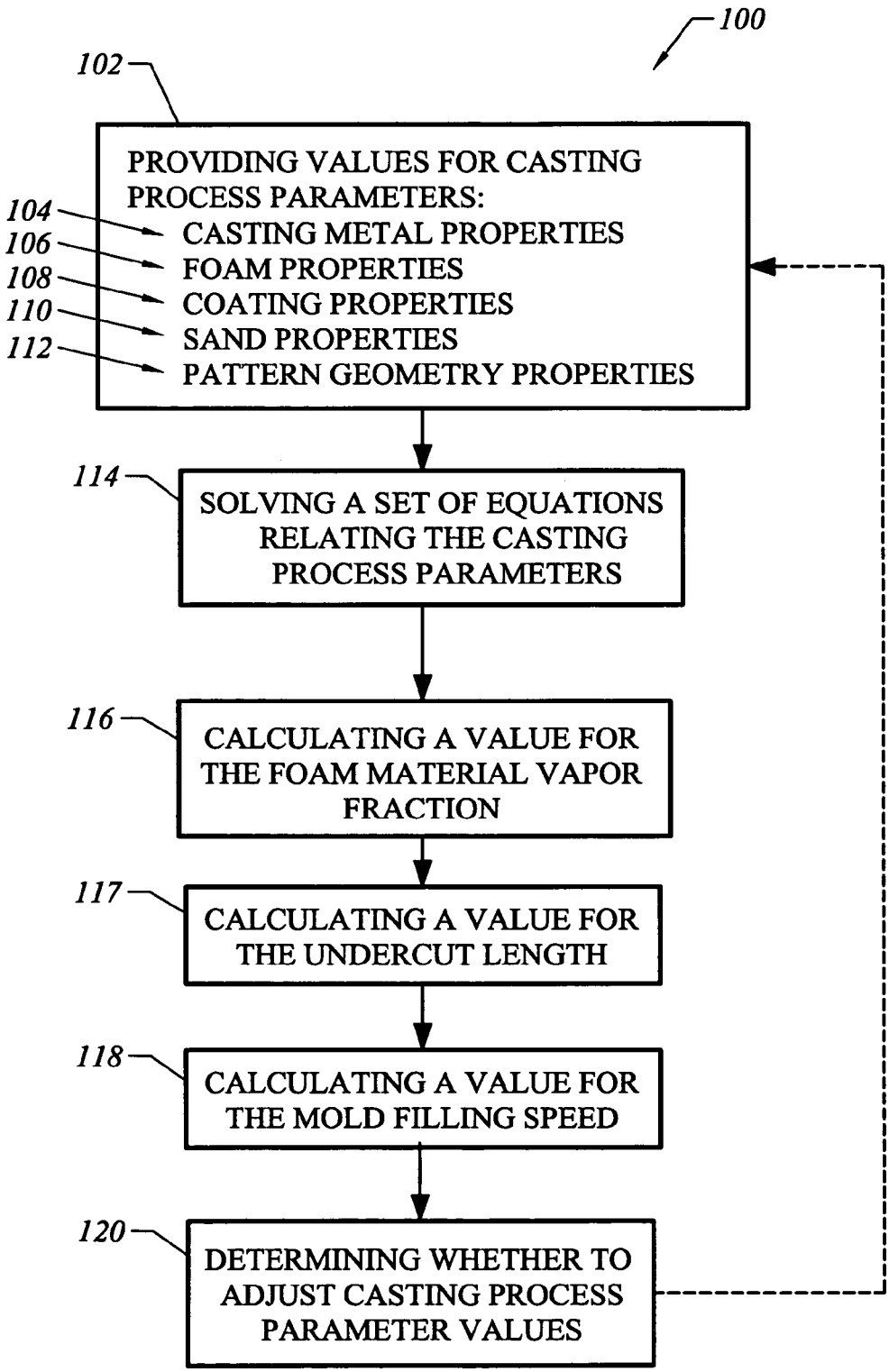
FIG. 2 shows a flowchart for performing an embodiment of the mathematical algorithms as described herein.

FIG. 2 shows a flow chart 100 of an embodiment of the method described herein. In step 102, values for casting process parameters are provided as variables to the set of equations as will be described below. Other variables as will be described are provided as well. Casting process parameters include casting metal properties 104, properties 106 of the foam material, properties of a foam pattern coating 108, properties 110 of the sand in which the coated foam pattern is embedded during the casting process, and pattern geometry characteristics 112. Metal used in lost foam casting may include aluminum or magnesium alloys, but other metals may be used as well. As mentioned, several parameters are provided as variables to a set of equations. It will be understood that the set of equations may be revised from the exemplary equations that are described below to include fewer or more properties. The output from the calculations is used to adjust at least one of the casting process parameters for improved casting. For example, casting metal parameters 104 include its temperature and its pressure, the latter commonly expressed in the form of the equivalent metal head. A lost foam casting process using aluminum as the casting metal may use a metal temperature between 600 and 800 degrees Celsius. The metal head may range from a few centimeters to more than a meter. The choice of these values to be inserted in the equations (see below) may depend on the size and geometry of the casting, and may also depend on other parameters associated with the casting process. Moreover, for magnesium alloys, iron alloys, or other metals, these metal

TABLE 1

| Casting Metal Properties for Aluminum | |
|---|---|
| Property | Aluminum alloy |
| Temperature (C.) | 600-800 |
| Metal head (m) | 0.1-1.0 |

parameters generally have different values. Table 1 lists representative casting metal parameters for aluminum.

Another group of casting process parameters includes foam material properties 106 that may include a nominal foam density, a foam boundary density, and a polymer density. The foam boundary density may differ from the nominal foam density, in general. This may happen, for instance, if the foam pattern is molded (in a separate process) rather than cut from a larger foam block. Foam material properties may also include a nominal cell size. Typical values for these properties are provided in Table 2 for polystyrene foam.

TABLE 2

| Foam Material Properties | | | |
|---|---|---|---|
| Property | Symbol | Value | Unit |
| Nominal foam density | $\rho_F$ | 25 | kg/m$^3$ |
| Foam boundary density | $\rho_B$ | 50 | kg/m$^3$ |
| Polymer density | $\rho_S$ | 800 | kg/m$^3$ |
| Nominal cell size | $\delta_0$ | 50 | μm |

Another group of casting process parameters includes foam thermal properties 106 that may include a thermal conductivity, a foam material melting temperature, and values for a melting energy, degradation energy, and vaporization energy for the foam material. Additional foam thermal properties include specific heat values for the foam material in solid, liquid, and vapor states. Table 3 lists representative values for these properties.

Other physical properties of the foam material include the molecular weight and viscosity of the vapor. Typical values for these properties are listed in Table 4.

TABLE 3

| Foam Thermal Properties | | | |
|---|---|---|---|
| Property | Symbol | Value | Unit |
| Thermal conductivity | $k_D$ | 0.04 | W/m-K |
| Melting temperature | $\theta_P$ | 150 | ° C. |
| Melting energy | H | 0 | J/g |
| Degradation energy | $H_D$ | 670 | J/g |
| Vaporization energy | $H_V$ | 360 | J/g |
| Specific heat of solid | $c_S$ | 1.5 | J/g-K |
| Specific heat of liquid | $c_L$ | 2.2 | J/g-K |
| Specific heat of vapor | $c_V$ | 2.2 | J/g-K |

TABLE 4

| Additional Foam Physical Properties | | | |
|---|---|---|---|
| Property | Symbol | Value | Unit |
| Molecular weight of vapor | $M_V$ | 104 | g/mole |
| Viscosity of gas | $\mu_G$ | $2 \times 10^{-5}$ | Pa-s |

Yet another of the casting process parameters is the viscosity of the liquid foam material that may be characterized in its temperature dependence by a relation $$\mu_D=\mu_0 \exp(-A\square_D)$$

involving an overall scale coefficient $\mu_0$ along with an inverse temperature coefficient A which characterizes the dependence of the viscosity on the temperature of the liquid foam. In this equation, $\square_D$ is the average temperature of the liquid foam in the decomposition layer. Properties for two commercial foams from STYROCHEM Corporation are listed in Table 5. The first is a standard polystyrene foam (T170) and the second (T175) is the same material with an organic brominated additive to promote faster polymer degradation.

TABLE 5

| Foam Liquid Viscosity Properties | | | |
|---|---|---|---|
| Coefficient | T170 | T175 | Unit |
| $\mu_0$ | $1.1 \times 10^8$ | 81 | Pa-s |
| A | 0.042 | 0.023 | 1/K |

Additional kinetic parameters of the foam are contained in an assumed Arrhenius relation characterizing the rate of vaporization $r_v$ of the foam material in the decomposition layer, $$r_v=a \exp(-E/R\square_M)(1-x_v)^n$$

which includes a magnitude a, an exponent n, and an activation energy parameter E. Additionally R is the universal gas constant 8.3144 J/mole-K, $\square_M$ is the temperature of the liquid metal in contact with the vaporizing foam material, and $x_v$ is the foam material vapor fraction, as mentioned above. Values for these kinetic parameters may be obtained from experimental foam pyrolysis data. Representative values that may be obtained from such analysis are provided in Table 6, again for the two commercially available foams.

TABLE 6

| Foam Kinetic Parameters | | | |
|---|---|---|---|
| Parameter | T170 | T175 | Unit |
| α | 13000 | 220 | kg/m$^2$-s |
| E | 90 | 56 | kJ/mole |
| n | 1.9 | 2.3 | |

Other casting process parameters are material properties of the coating 108 that may include gas permeability, porosity, thickness, bulk density, and specific heat. Properties of the sand 110 may include gas permeability and porosity. Properties characterizing the foam pattern geometry 112 may include a local pattern thickness. Typical values for properties of the coating and sand are provided in Table 7.

Casting process parameters, such as those listed in Tables 1-7, are related to other properties of the casting process, such as the foam material vapor fraction $x_v$, the undercut length $l_C$, and the mold filling speed u among other properties, through a set of equations. These equations are described in connection with FIG. 3 below. As mentioned above, solving the set of equations 114 provides a way of calculating an output value for the foam

TABLE 7

Sand and Coating Properties

Figure 4:
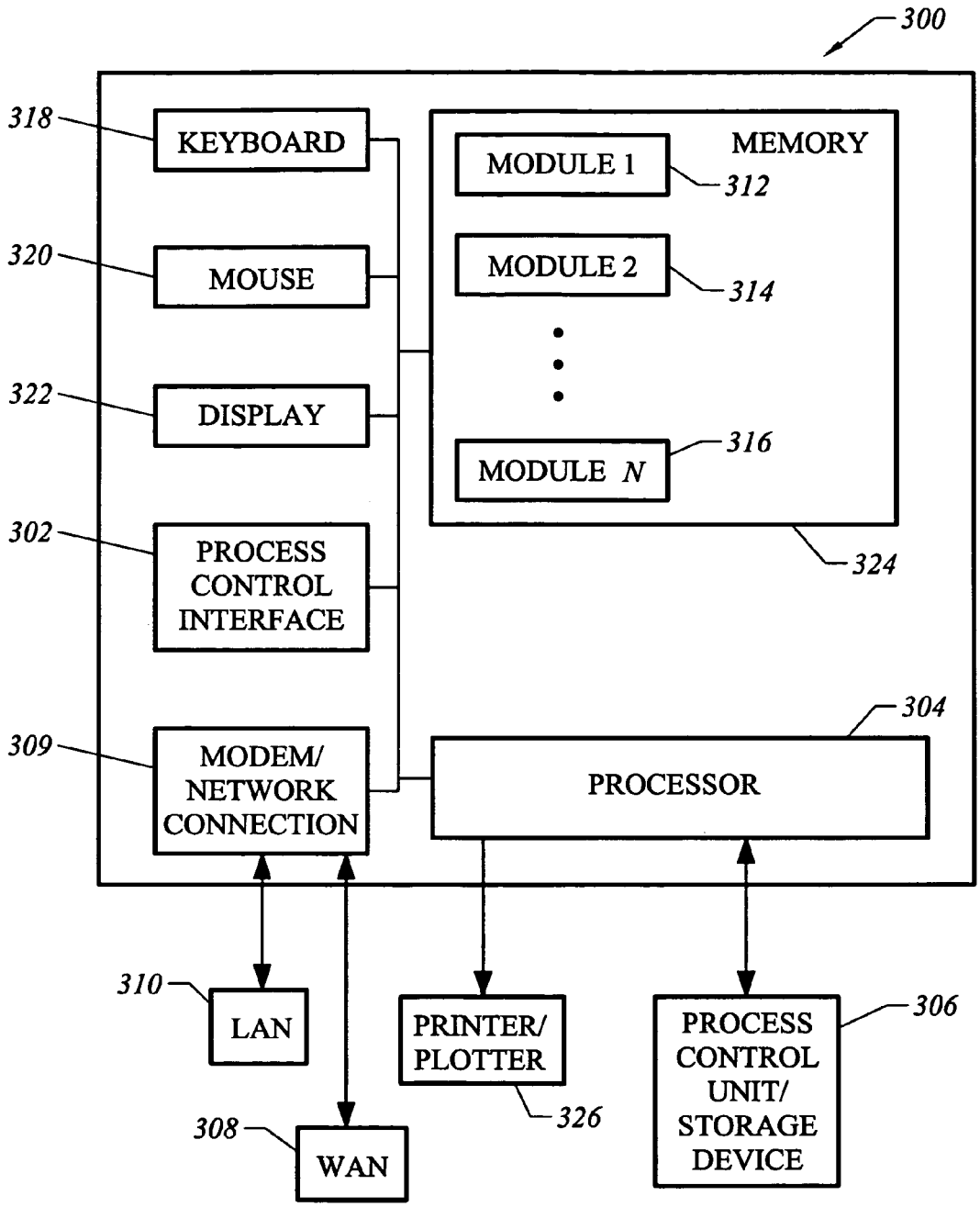
FIG. 4 shows an embodiment of a system for utilizing algorithms and software, and testing the lost foam casting process and making adjustments to the input parameters.

| | Property | Symbol | Value | Unit |
|---|---|---|---|---|
| Sand | Permeability | $\kappa_S$ | 100 | $\mu m^2$ |
| | Porosity | $\theta_S$ | 0.4 | |
| Coating | Permeability | $\kappa_C$ | 0.02 | $\mu m^2$ |
| | Porosity | $\theta_C$ | 0.4 | |
| | Thickness | $d_C$ | 0.2 | mm |
| | Bulk density | $\rho_C$ | 1 | $g/cm^3$ |
| | Specific heat | $c_C$ | 1 | J/g-K |

material vapor fraction 116, the undercut length 117, and the mold filling speed 118. One or all of these values may be used (discussed below) in determining 120 whether to adjust casting process parameters for improved performance of a lost foam casting process. The system as shown in FIG. 4, as will be described in detail below, may rerun the referenced calculation with adjusted casting process parameters to generate a new foam material vapor fraction 116, a new undercut length 117, and a new mold filling speed 118 as output. A determination may be made as to whether the process is improved. If it is found that the process is improved, adjustments may be made to the actual casting process, via, for example, a process control unit for active control of the actual casting system.

Figure 3:
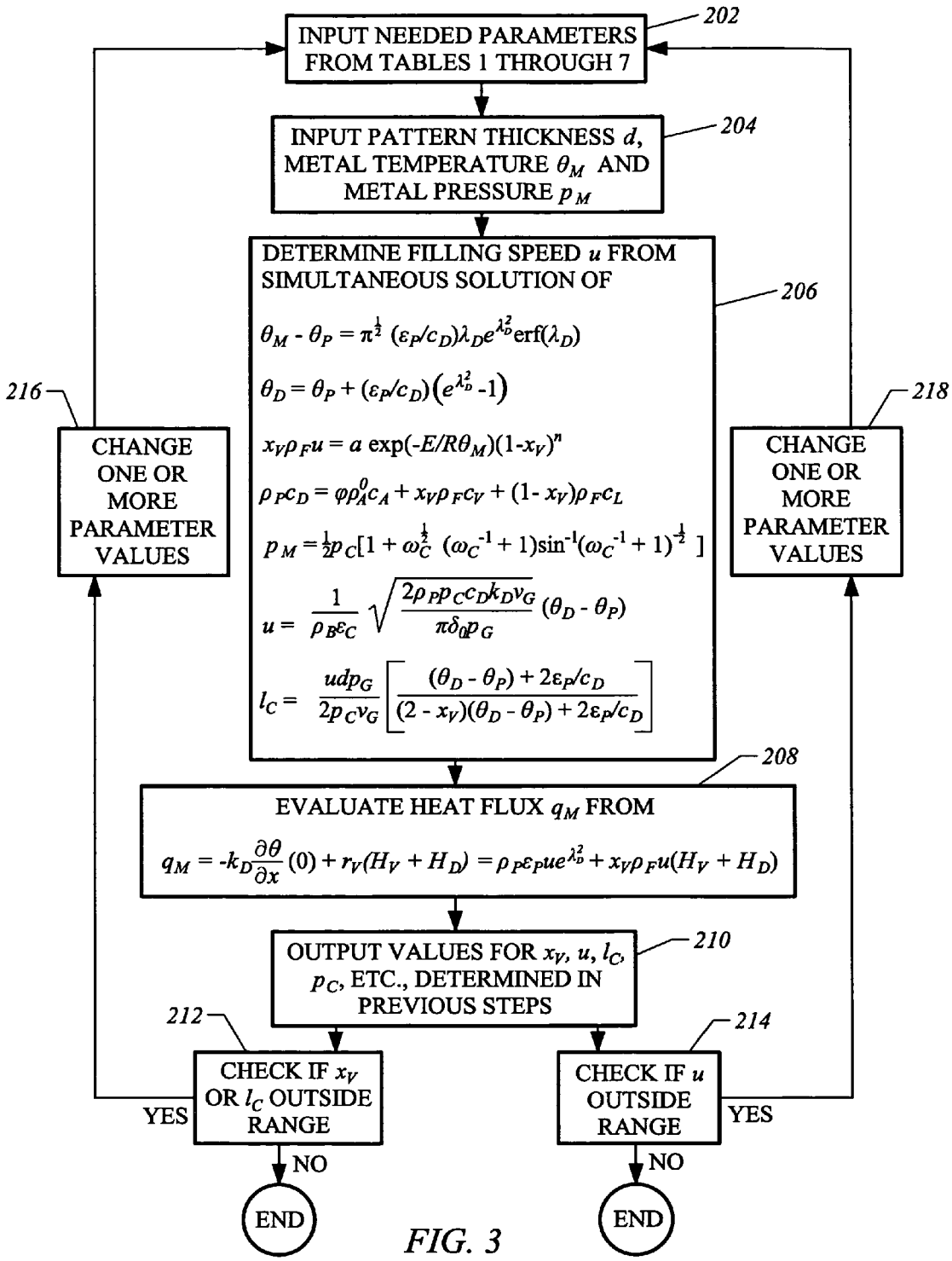
FIG. 3 depicts the algorithm for analysis of lost foam casting in contact mode, showing steps of an embodiment.

Turning now to FIG. 3, the above-mentioned set of equations relating casting process properties is described. The equations are provided with initial casting process variables and then solved simultaneously. The output includes a foam material vapor fraction (vapor value), an undercut length value (undercut value), and a mold filling speed (speed value). Depending upon the vapor value, the undercut value, and the speed value, the algorithm includes adjusting the casting process values and then again solving the equations simultaneously. If the process is improved as determined from the output, an active control may adjust the actual casting process.

As mentioned above, the equations include additional variables and those are described herein. In general, FIG. 3 depicts the algorithm for analysis of lost foam casting in contact mode. In general terms, FIG. 3 is a flow chart showing steps of an embodiment. Parameters specifying properties of the materials used in the lost foam casting process are designated at an input step. As discussed below, these properties may include those listed in Tables 1 through 7 202. In an input step 204, the input pattern thickness d, the temperature $\square_M$ of the liquid metal, and the metal pressure $p_M$ are specified. Numerical methods may be used to simultaneously solve a set of coupled equations 206 relating thermal properties, flow properties, and other physical properties of the metal and foam. The heat flux from the molten metal is evaluated 208 using the values of physical quantities determined during the numerical solution step 206. Many of these values are output in a subsequent step 210. Once values for the polymer or other foam material vapor fraction $x_v$, the undercut length value $l_C$, and liquid metal flow speed or mold filling speed u have been determined, these values are checked to see if they lie within appropriate ranges 212 and 214. If not, one or more parameter values may be changed 216 and 218 and the method re-executed.

As shown in FIG. 4, to be discussed below, the system may include a process control interface 302 and the processor unit 304 may also send output data to a process control unit including a storage device 306 so that active control of the lost foam casting process may take place through communication unit WAN 308 via modem/network connection 309. Network connection 309 may also provide connection through communication unit LAN 310.

The variables included in the algorithm depicted in FIG. 3 are now described in greater detail, including their relationship to one another. The volume fraction of air in the foam material is denoted herein by □ It is a measurable quantity determined by the foam molding process that typically ranges between 0.96 and 0.98. With $\square_A^0$ denoting the density of air at the initial foam pattern temperature $\square_0$ and atmospheric pressure $p_0$, the total density of the foam pattern material $\square_p$ is given by $$\square_p=\square\square_A^0+\square_F,$$

with the nominal foam density $\square_F$ provided in Table 2 above. Incidentally, $\square_F$ is related to the polymer density $\square_S$ of Table 2 by $$\square_F=(1-\square)\square_S,$$

and is the partial density of the polymer in the foam.

The energy per unit mass $\square_P$ required to heat the foam material from its initial temperature $\square_0$ to its melting temperature $\square_P$ is given by $$\square_P\square_P=(\square\square_A^0c_A+\square_Fc_S)(\square_P-\square_0)+\square_FH_M.$$

Values for quantities appearing on the right side of this equation are listed in the Tables above or readily available in standard references for physical properties. For example, the specific heat of air at 0° C. and atmospheric pressure is 1 J/g-K. Since most foam materials are amorphous polymers, the latent heat of fusion $H_M$ is usually negligible.

The average specific heat $c_D$ in the decomposition layer is given by $$\rho_Pc_D=\omega\rho_A^0c_A+x_v\rho_Fc_v+(1-x_v)\rho_Fc_L$$

The polymer vapor and liquid specific heats, $c_v$ and $c_L$, respectively, on the right side of this equation are given in Table 3, and are assumed approximately constant over the temperature range in the decomposition layer. The specific heat of air in the decomposition layer $c_A$, which is also assumed to be constant over the temperature range in the decomposition layer, can be estimated from tabulated values in standard references. The average density $\square_D$ of the liquid foam in the decomposition layer may be derived assuming that the air and polymer vapor behave as ideal gases. With $M_v$ as the mass-average molecular weight of the polymer vapor, the average mass density $\square_D$ in the decomposition layer is then given by $$\rho_D=\frac{\rho_P}{(1-x_V)(1-\varphi)+x_V\rho_F\dfrac{R\theta_D}{p_DM_V}+\varphi\dfrac{p_0\theta_D}{p_D\theta_0}}.$$

The Peclet number $\square_D$ in the decomposition layer, defined by $$\lambda_D^2=\frac{\rho_Pc_Dul_D}{2k_D},$$

may be related to the metal temperature by $$\square_M=\square_P+(\epsilon_P/c_D)\pi^{1/2}\square_D\exp(\square_D^2)erf(\square_D).$$

In the definition of Peclet number, $l_D$ is the distance between the liquid metal surface and the solid foam surface, and defines the thickness of the decomposition layer. $k_D$ is the bulk thermal conductivity of the liquid foam in the decomposition layer. The equation for the Peclet number may be derived by considering boundary conditions on heat conduction in the decomposition layer. The average temperature in the decomposition layer $\square_D$ is related to the value of $\square_D$ by $$\square_D=\square_P+(\epsilon_P/c_D)(\exp(\square_D^2)-1).$$

The Arrhenius relation discussed above may be used, with $r_v=x_v\square_F u$, to provide a relation between $x_v$ and u:

$$x_v\square_F u=a\exp(-E/R\square_M)(1-x_v)^n$$

The pressure of the air/polymer vapor mixture elevated to the average temperature of the decomposition layer and contained in the original volume of foam is given by $$p_G=(x_v\square_F R/M_v+\square p_0/\square_0)\square_D$$

and denoted herein as the gas generation pressure. It depends on $x_v$ and $\theta_D$. It may be used to determine a relation between the pressure just inside the coating $p_C$, the filling speed u, and the thickness of the decomposition layer $l_D$, in terms of known variables:

$$p_M=\frac{1}{2}p_C\left[1+\omega_C^{1/2}(\omega_C^{-1}+1)\sin^{-1}(\omega_C^{-1}+1)^{-1/2}\right],$$

where $$\square_C=3\mu_D p_G u\, d^2/(p_C^2 l_D^3)$$

and d is the pattern thickness. The relation between metal pressure $p_M$ and coating pressure $p_C$ follows from an analysis of viscous pressure loss in the decomposition layer, assuming lubrication theory provides a valid model for the liquid foam in the decomposition layer.

A relation for the one dimensional filter velocity $v_G$ of the escaping gas through the porous coating may be derived, $$v_G=[\square_C/(\mu_G d_C)][(p_C^2-p_S^2)/(2p_c)]$$

where $p_s$ is the pressure in the sand and $\square_C$ is the coating permeability, given in Table 7. The gas viscosity, $\mu_G$, is given in Table 4. It is assumed to be constant and apply to the mixture of air and polymer vapor in the decomposition layer. For aluminum casting, where the coating provides the major barrier to gas diffusion, it may be a good approximation to take $p_s$ equal to $p_0$, so that $$v_G=[\square_C/(\mu_G d_C)][(p_C^2-p_0^2)/(2p_C)]$$

may be used.

For iron casting, where coatings may have a permeability more than ten times higher than those for aluminum, there may be a significant pressure drop in the sand. It can be shown that, under certain assumptions on the pattern geometry and the casting process, $p_s$ satisfies an inequality $$\frac{p_S-p_0}{p_C-p_S}\le-\frac{1}{\pi}\frac{\kappa_C l_C}{\kappa_S d_C}\ln\left(\frac{\varphi_S\mu_G u l_C}{4\kappa_S p_0}\right)$$

where $\square_S$, $\square_S$, and $d_C$ are given in Table 7. This expression bounds the error in neglecting the diffusive resistance of the sand.

Polystyrene foam collapses at about 120° C., less than 100 degrees above the typical initial pattern temperature, which should be equal to the sand temperature by the time the casting is poured. A collapse energy $\square_C$ for the foam pattern may be defined through $$\square_P\square_C=(\square\square_A{}^0C_A+\square_F C_S)(\square_C-\square_0)$$

where it is supposed that the foam collapses at the temperature $\square_C$, in the neighborhood of 120° C., as mentioned above.

Analysis of the coating undercut provides a further relation among the mold filling speed u and the other variables, namely $$u=\frac{1}{\rho_B\varepsilon_C}\sqrt{\frac{2\rho_P p_C c_D k_D v_G}{\pi\delta_0 p_G}}(\theta_D-\theta_P)$$

with $\square_B$ and $\square_0$ provided in Table 2. Combined with previous equations involving u, $x_{v,\ pC}$, $\square_P$, and $c_D$, a simultaneous solution provides values for these variables. There are known methods for solving such a system of equations using a computer. Once the simultaneous equations have been solved, values for $x_v$ and u can be provided for casting process analysis. A value for the undercut length may be calculated from $$l_C=\frac{p_G u d}{2p_C v_G}\left[\frac{(\theta_D-\theta_P)+2\varepsilon_P/c_D}{(2-x_V)(\theta_D-\theta_P)+2\varepsilon_P/c_D}\right].$$

FIG. 4 shows a system 300 for analyzing lost foam casting according to an embodiment as disclosed herein. The system incorporates a processor unit 304 and software modules 312, 314, up to 316 which are, for example, an equation module for providing a plurality of casting process parameters as variables in a plurality of predetermined equations, a solution module for simultaneously solving the plurality of predetermined equations including the property values, a calculation module for calculating a vapor value for the foam material vapor fraction, an undercut value for the length of the undercut, and a speed value for the mold filling speed, and an adjustment module determining whether to adjust at least one of the property values based on analysis of the vapor value, the undercut value, and the speed value.

User interface items depicted in FIG. 4 include a keyboard 318, a mouse or other pointing device 320, and a display device 322. The system may also include a process control interface unit 302, as previously described, to provide for manipulation of process control parameters for ongoing lost foam casting activities. In addition, a modem or network connection unit 309 may provide for connection to a local area network (LAN) 310 or a wide area network (WAN) 308 to facilitate communication and fetching of parameter values from, or distribution of results to, other computing devices or peripherals. It is understood that manual or automatic input and operations are contemplated herein.

The method, system and apparatus utilizing the method and system as described herein may have a number of different modules for different modes occurring during the lost foam casting process. The modules may work in series or parallel, analyzing the conditions, making predictions for the process of lost foam casting and providing for the adjustment of parameters either manually or automatically to improve results.

A memory unit 324 is provided for storage of software modules implementing the algorithms. The processor unit executes the instructions of the software modules 312, 314, up to 316, which may be stored in memory module 324. The processor unit is connected to each of the user interface items, as well as to the process control interface, if present, and to the modem and/or network connection unit. In addition, connection is provided for a printer or plotter device 326, and for external storage. The process control unit including a storage device may include, besides a process control unit, a floppy drive, CD drive, external hard disk, or magneto-optical or other type of drive.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

The invention claimed is

1. A method for analyzing foam decomposition by ablation through contact between the foam and the molten metal during mold filling in lost foam casting, the foam decomposition having a foam material vapor fraction and the mold filling having a mold filling speed, the method comprising:

performing a lost foam casting process;

measuring a plurality of parameter values for casting process parameters in said lost foam casting process as variables in a plurality of predetermined equations;

providing a computer-readable medium encoding the following steps:

simultaneously solving the plurality of predetermined equations including the parameter values;

calculating a vapor value for the foam material vapor fraction and a speed value for the mold filling speed;

and determining whether to adjust at least one of the parameter values based on an analysis of the vapor value and the speed value;

and optionally adjusting said at least one parameter value in said lost foam casting process.

2. A method as recited in claim 1, wherein the lost foam casting process includes a foam pattern having a coating, the lost foam casting process producing gas that diffuses through the coating on the foam pattern leading to gas diffusion at a flow front, the step of calculating further comprising: calculating an amount of coating exposed to gas diffusion at the flow front.

3. A method as recited in claim 1, wherein one of the plurality of parameter values is a casting metal pressure.

4. A method as recited in claim 1, wherein one of the plurality of parameter values is a foam property.

5. A method as recited in claim 1, wherein one of the plurality of parameter values is a coating property.

6. A method as recited in claim 1, wherein one of the plurality of parameter values is a sand property.

7. A method as recited in claim 1, wherein the vapor value has a predetermined range and wherein determining whether to adjust values of one or more of the casting process parameters comprises:

checking whether the vapor value lies in the predetermined range.

8. A method as recited in claim 1, wherein the speed value has a predetermined range and wherein determining whether to adjust values of one or more of the casting process parameters comprises:

checking whether the speed value lies in the predetermined range.

9. A method as recited in claim 1, further comprising: generating adjustment data;

sending the adjustment data to a process control unit for active control of a casting process.

10. A system for analyzing foam decomposition by ablation through contact between the foam and the molten metal during mold filling in lost foam casting, the foam decomposition having a foam material vapor fraction and the mold filling having a mold filling speed, the system comprising: a computer-readable medium encoded with a program comprising: an equation module for providing a plurality of parameter values for casting process parameters as variables in a plurality of predetermined equations;

a solution module for simultaneously solving the plurality of predetermined equations including the parameter values;

a calculation module for calculating a vapor value for the foam material vapor fraction and a speed value for the mold filling speed;

and an adjustment module for determining whether to adjust at least one of the parameter values based on an analysis of the vapor value and the speed value.

11. A system as recited in claim 10, wherein the lost foam casting process includes a foam pattern having a coating, the lost foam casting process producing gas that diffuses through the coating on the foam pattern leading to gas diffusion at a flow front, the calculation module further calculates an amount of coating exposed to gas diffusion at the flow front.

12. A system as recited in claim 10, wherein the plurality of parameter values comprises a casting metal pressure, a foam property, a coating property, and a sand property.

13. A system as recited in claim 10, wherein the vapor value has a predetermined range and wherein the speed value has a predetermined range and wherein the adjustment module comprises:

a first checking module for checking whether the vapor value lies in the predetermined range; and a second checking module for checking whether the speed value lies in the predetermined range.

14. An apparatus for analyzing foam decomposition and mold filling in a lost foam casting process in contact mode, the foam decomposition having a foam material vapor fraction and the mold filling having a mold filling speed, the system comprising:

a memory unit;

a parameter instruction unit including parameter instructions for retrieving a plurality of process parameter values from the memory unit;

a solution instruction unit including solution instructions for simultaneously solving a plurality of equations having process parameter values;

a calculating instruction unit including calculation instructions for calculating values for the foam material vapor fraction and the mold filling speed;

a processor for receiving parameter instructions, solution instructions and calculation instructions and generating values for the foam material vapor fraction and the mold filling speed;

and an adjustment instruction unit including adjustment instructions for determining whether to adjust values of one or more of the process parameter values according to the foam material vapor fraction and the mold filling speed.

15. An apparatus as recited in claim 14, wherein the lost foam casting process includes a foam pattern having a coating, the lost foam casting process producing gas that diffuses through the coating on the foam pattern leading to gas diffusion at a flow front, the calculating instruction unit further comprising: calculation instructions for calculating an amount of coating exposed to gas diffusion at the flow front.

16. An apparatus as recited in claim 14, wherein one of the plurality of process parameter values is a casting metal pressure.

17. An apparatus as recited in claim 14, wherein one of the plurality of process parameter values is a foam property.

18. An apparatus as recited in claim 14, wherein one of the plurality of process parameter values is a coating property.

19. An apparatus as recited in claim 14, wherein one of the plurality of process parameter values is a sand property.

20. An apparatus as recited in claim 14, wherein the foam material vapor fraction has a predetermined range and wherein the mold filling speed has a predetermined range and the adjustment instructions further include instructions for determining whether to adjust values of one or more of the process parameter values, comprising:

a first checking unit including instructions for checking whether the vapor value lies in the predetermined range;

and a second checking unit including instructions for checking whether the speed value lies in the predetermined range.

* * * * *